US006286169B1

(12) United States Patent
D'Costa et al.

(10) Patent No.: US 6,286,169 B1
(45) Date of Patent: Sep. 11, 2001

(54) TESSELLATED CYLINDRICAL BRUSH

(75) Inventors: Joseph F. D'Costa, New Hope; Michael T. Basham; Warren L. Larson, both of Maple Grove, all of MN (US)

(73) Assignee: Tennant Company, Golden Valley, MN (US)

( * ) Notice: Subject to any disclaimer, the term of this patent is extended or adjusted under 35 U.S.C. 154(b) by 0 days.

(21) Appl. No.: 08/789,140

(22) Filed: Jan. 27, 1997

(51) Int. Cl.[7] ..... A47L 11/24; E01H 1/04; A46B 9/02

(52) U.S. Cl. ..... 15/52.1; 15/82; 15/179; 15/182

(58) Field of Search ..... 15/41.1, 50.3, 15/52, 52.1, 53.2, 82, 88.3, 88.4, 179, 181, 182, 183, 366

(56) References Cited

U.S. PATENT DOCUMENTS

| | | | | |
|---|---|---|---|---|
| 455,017 | * | 6/1891 | Hothersall | 15/179 |
| 732,999 | * | 7/1903 | Brantley | 15/179 |
| 1,329,931 | * | 2/1920 | Schneider | 15/179 |
| 1,957,506 | | 5/1934 | Smellie . | |
| 2,014,626 | * | 9/1935 | Moorhead | 15/52.1 |
| 2,659,921 | * | 11/1953 | Osborn | 15/182 |
| 2,680,083 | | 6/1954 | Sharf et al. . | |
| 2,879,534 | | 3/1959 | Swanson et al. . | |
| 2,907,064 | | 10/1959 | Erickson . | |
| 3,065,481 | * | 11/1962 | Peterson | 15/183 |
| 3,106,733 | * | 10/1963 | Le Counte | 15/52.1 |
| 4,114,221 | * | 9/1978 | Enchelmaier | 15/182 |
| 4,276,674 | | 7/1981 | Hunt . | |
| 4,357,727 | | 11/1982 | McDowell . | |
| 4,531,249 | * | 7/1985 | Sternberg | 15/52.1 |
| 4,586,211 | | 5/1986 | Phillips . | |
| 4,658,460 | * | 4/1987 | Edoardo | 15/182 |
| 4,662,044 | * | 5/1987 | Kayabara | 15/183 |
| 4,724,564 | | 2/1988 | Fresh . | |
| 4,912,805 | | 4/1990 | Krasznai et al. . | |
| 5,375,291 | * | 12/1994 | Tateyama | 15/88.3 |
| 5,495,634 | | 3/1996 | Brundula et al. . | |

FOREIGN PATENT DOCUMENTS

| | | | | |
|---|---|---|---|---|
| 1290919 | * | 3/1969 | (DE) | 15/183 |
| 3247087 | * | 6/1984 | (DE) | 15/50.3 |
| 499537 | * | 1/1939 | (GB) | 15/179 |
| 998043 | * | 7/1965 | (GB) | 15/179 |
| 0044208 | * | 3/1984 | (JP) | 15/179 |
| 1621856 | * | 1/1991 | (SU) | 15/182 |

* cited by examiner

*Primary Examiner*—Randall E. Chin
(74) *Attorney, Agent, or Firm*—Schwegman, Lundberg, Woessner & Kluth PA

(57) ABSTRACT

A sweeping machine for picking up debris from a surface includes a frame and wheels attached to said frame to support the frame of the sweeping machine over the surface being swept. A cylindrical brush is rotatably attached to said frame. The cylindrical brush includes a tubular main body and tufts attached to said tube such that the tufts extend radially outward from said tube. The tube has regions devoid of tufts bounded by regions having tufts. The sweeping machine also includes a mechanism for rotating said cylindrical brush.

9 Claims, 9 Drawing Sheets

TESSELLATED CYLINDRICAL BRUSH

FIELD OF THE INVENTION

The present invention relates to the field of sweeping machines. More particularly, this invention relates to a sweeping machine for picking up various types of debris from a surface being swept.

BACKGROUND OF THE INVENTION

There are many types of sweeping machines for removing various types of debris from a surface, such as the ground, a floor or a parking lot. Many of these sweeping machines use a rotating cylindrical brush to contact the surface being swept. The rotating cylindrical brush is used to lift various types of debris from the floor or surface and throw it into a debris hopper located near the rotating cylindrical brush. The machine moves the rotating cylindrical brush over the surface being swept. The rotational velocity of the cylindrical brush produces a velocity at the ends of the brush that differs from the velocity of the machine as it moves over the surface being swept. The brush can be rotated in either direction. There are many types of sweepers. Two types of sweepers are forward throw sweeper and indirect throw sweepers. Forward throw sweepers use a brush rotated backward with respect to the travel of the sweeping. The debris is thrown forward and collected in a container which is forward of the brush. Indirect throw or over-the-top sweepers use a brush rotated in either direction with a debris container located behind the brush with respect to the direction of travel.

Sweeping machines are used in a variety of environments. For example, some sweeping machines remove debris from roads and streets. Others are used to remove debris from parking lots and others are used to remove debris from factory floors. In short, there are many applications for sweeping machines. Sweeping machines also remove different types of debris. Certain design considerations can be employed to enhance a sweeping machine's ability to pick up or remove certain types of debris.

One such design consideration is referred to as conformance. Conformance is the amount of contact between the rotating cylindrical brush and the surface being swept. High conformance is needed to remove sand, for example. The most effective sweeping machines are generally specifically designed for a particular surface and removal of a particular type of debris.

Of course, one of the most important design considerations is the design of the brush. Brushes can be designed for very specific purposes. For example, in U.S. Pat. No. 4,586,211 the brush is adapted to sweep tile floors. Some of the bristles on the brush in U.S. Pat. No. 4,586,211 are arranged in a plurality of circular rows. The dimension between specific rows of the brush are spaced from one another along the fall length of the core of the brush at the same dimension as either the lengthwise or widthwise dimension of the tiles. The bristles can be made of any of the various types of brush fill materials, which include fibers of plant or animal origin, synthetic filaments, metallic materials, or composite filaments.

Most sweeping environments do not lend themselves to sweeping just one kind of debris or for use in one specialized environment such as the tile sweeper mentioned above. The most challenging designs are those for picking up a variety of debris in one of several environments. In most sweeping environments, it is desirable to be able to pick up all sorts of debris. One difficulty is designing a sweeping machine capable of picking up a wide variety of debris, from light litter, mil-spec hardware, containers, all the way to bulky debris and debris with mixed aspect ratios. A brush that picks up heavy debris is often less effective at picking up light litter, sand and fine particles.

Most brushes for use in a more generalized setting have problems. Some common problems are trailing and poor pickup of light litter. Trailing occurs when debris migrates to a certain area or position on the brush, such as an outside edge and then escapes. The result is a trail of debris, such as sand, that occurs at one location on the brush. Another common problem is poor pickup. It is not uncommon with some current brush and sweeper designs to have to use multiple sweeping passes in order to do an acceptable level of cleaning.

Paper or light litter generally requires a favorable air flow in order to be picked up effectively. In many instances, a turbulent air flow occurs toward the front of a rotating cylindrical brush making light litter difficult to pick up. The turbulent air flow tends to blow the trash around in front of the sweeping machine which makes it difficult to pick up.

A need exists for a sweeping machine that will efficiently sweep all types of debris, such as sand and gravel, light litter, mil-spec hardware, containers, bulky debris and debris with mixed aspect ratios. There is also a need for a sweeping machine that will consistently pick up varying types of debris on a variety of surfaces and one that limits axial migration of debris toward the ends of a rotating cylindrical brush. There is also a need for a brush that minimizes trailing. There is a further need for a sweeping machine that is smooth and stable during its operation.

SUMMARY OF THE INVENTION

A rotatable cylindrical brush for a sweeping machine includes a tube having sweeping material attached to said tube. The sweeping material extends radially outward from the surface of said tube. The sweeping material forms a plurality of first regions of sweeping material and a plurality of second regions devoid of sweeping material. The first regions bound the second regions on the tube.

The cylindrical brush for sweeping a surface to remove debris from the surface includes a cylindrical body or tube with bristles attached to said cylindrical body or tube. The bristles are attached to the cylindrical body of the brush to form a brush having a varied topography. The varied topography of the brush includes volumes that are devoid of bristles and volumes populated with bristles that surround the volumes devoid of bristles. The volumes devoid of bristles are also called windows or pockets in the brush. The volumes devoid of bristles produce a fan effect directing air flow in a direction more favorable for sweeping than the prior art and provide regions large enough to entrap debris. The pockets or windows also limit movement of the debris along the length of the cylindrical body of the brush. In other words, the debris is restricted in its travel along the length of the cylindrical body of the brush which helps to prevent debris from escaping at the ends of the cylindrical brush.

Advantageously, a sweeping machine equipped with the cylindrical brush mentioned above picks up or sweeps all types of debris, such as sand and gravel, light litter, mil-spec hardware, containers, bulky debris and debris with mixed aspect ratios. The volume devoid of sweeping material prevent axial migration of debris toward the ends of a rotating cylindrical brush. The areas devoid of sweeping material also produce a favorable air flow to pick up paper or light debris. The profile of the volumes which are populated with bristles can be set so that the borders between those regions or volumes are at an angle with respect to the axis of the cylinder so as to minimize trailing. Trailing is leaving debris in lines behind the brush after making a sweeping pass. By making the brush symmetrical and sizing the areas devoid of tufts appropriately, the sweeping machine is both smooth and stable during the sweeping operation. The multitude of inflection points on the instantaneous sweeping front causes the debris to rapidly change its orientation with which it encounters the sweeping tool.

DESCRIPTION OF THE PREFERRED EMBODIMENT

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1:
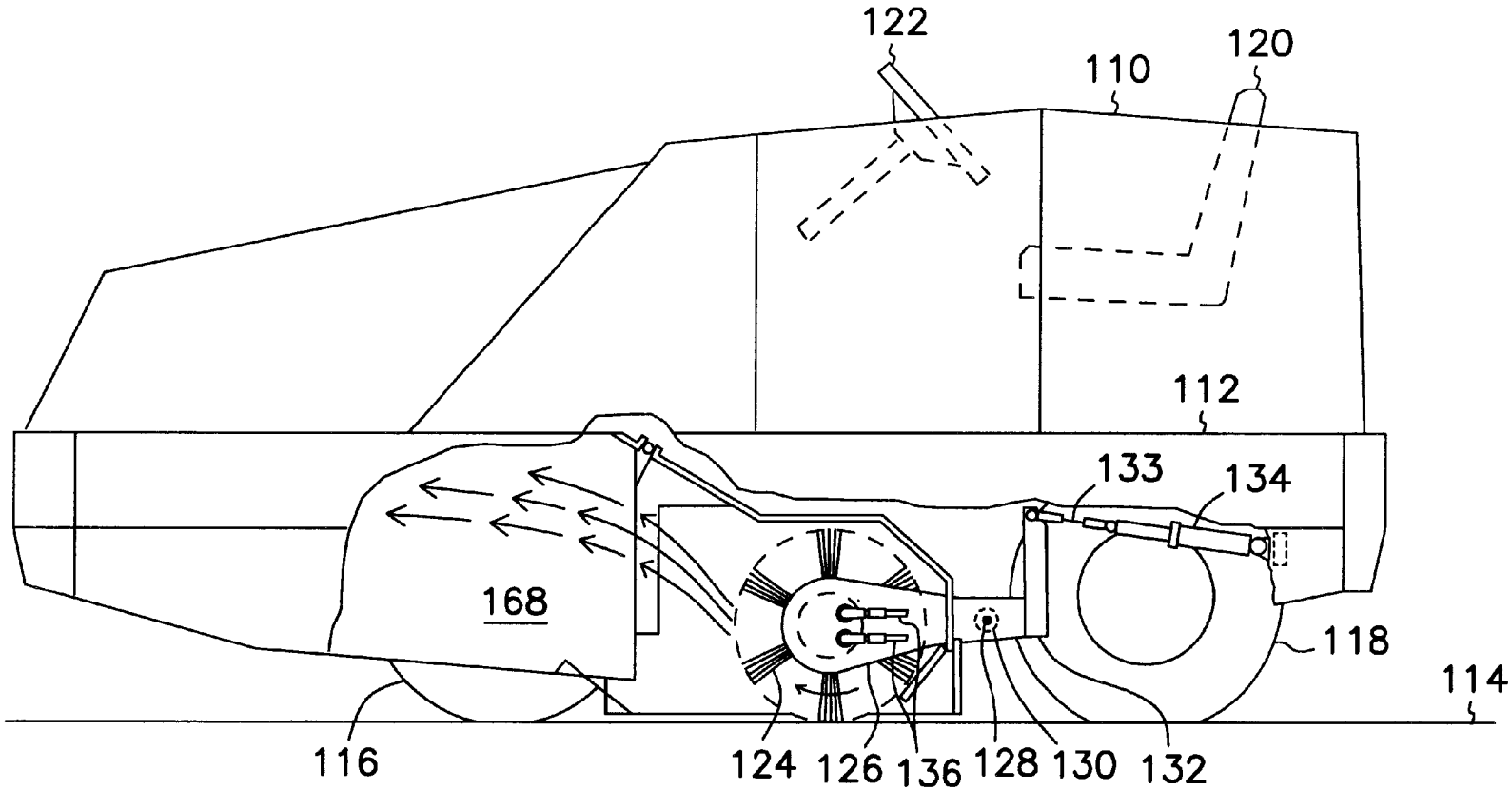
FIG. 1 is a side view of the sweeping machine.

FIG. 1 is a side view of a forward throw type sweeping machine which uses a preferred embodiment of the present invention. It should be noted that the brush can be used on any type of sweeping machine and that the one shown is for the purpose of illustration. The sweeper 110 has a frame 112 and is supported on a surface to be swept 114 by two free rolling front wheels 116 (only one shown) and one steerable, powered rear wheel 118. Provisions for a driver are indicated generally by a seat 120 and a steering wheel 122. Other conventional controls are also provided, but are not shown.

A cylindrical sweeping brush 124, is mounted in a conventional manner and extends across most of the transverse width of the sweeping machine. It is supported between two brush arms 126 (only one shown) which are attached in pivotal manner to the sides of the frame 112 at two transversely aligned points 128 (only one shown). A cross shaft 130 joins the two brush arms 126 together so that both ends of brush 124 are maintained in alignment. A lift arm 132 is welded or otherwise attached to one brush arm, and is pivotally connected at its upper end to a cable assembly 133. This connects to a hydraulic cylinder 134 which is used to raise the brush 124 off the surface 114 for transport, or lowered to its working position as shown in FIG. 1. In working position, cable assembly 133 may be slack. The engagement of brush 124 with surface 14 may be controlled by an adjustable down stop (not shown). This may be made in any one of several conventional ways. Commonly such a stop is a heavy screw bearing against a lug welded to cross shaft 130. A knob on the opposite end of the screw will be accessible to the driver. By turning the knob, the driver or operator can set the brush height for a desired floor contact, or pattern, and can re-set it when needed as the brush wears. Brush 124 is rotated by a hydraulic motor. This motor is supplied by hoses 136. The opposite brush arm 126 (not shown) carries an idler bearing assembly which rotatably supports the opposite end of brush 124.

Figure 2:
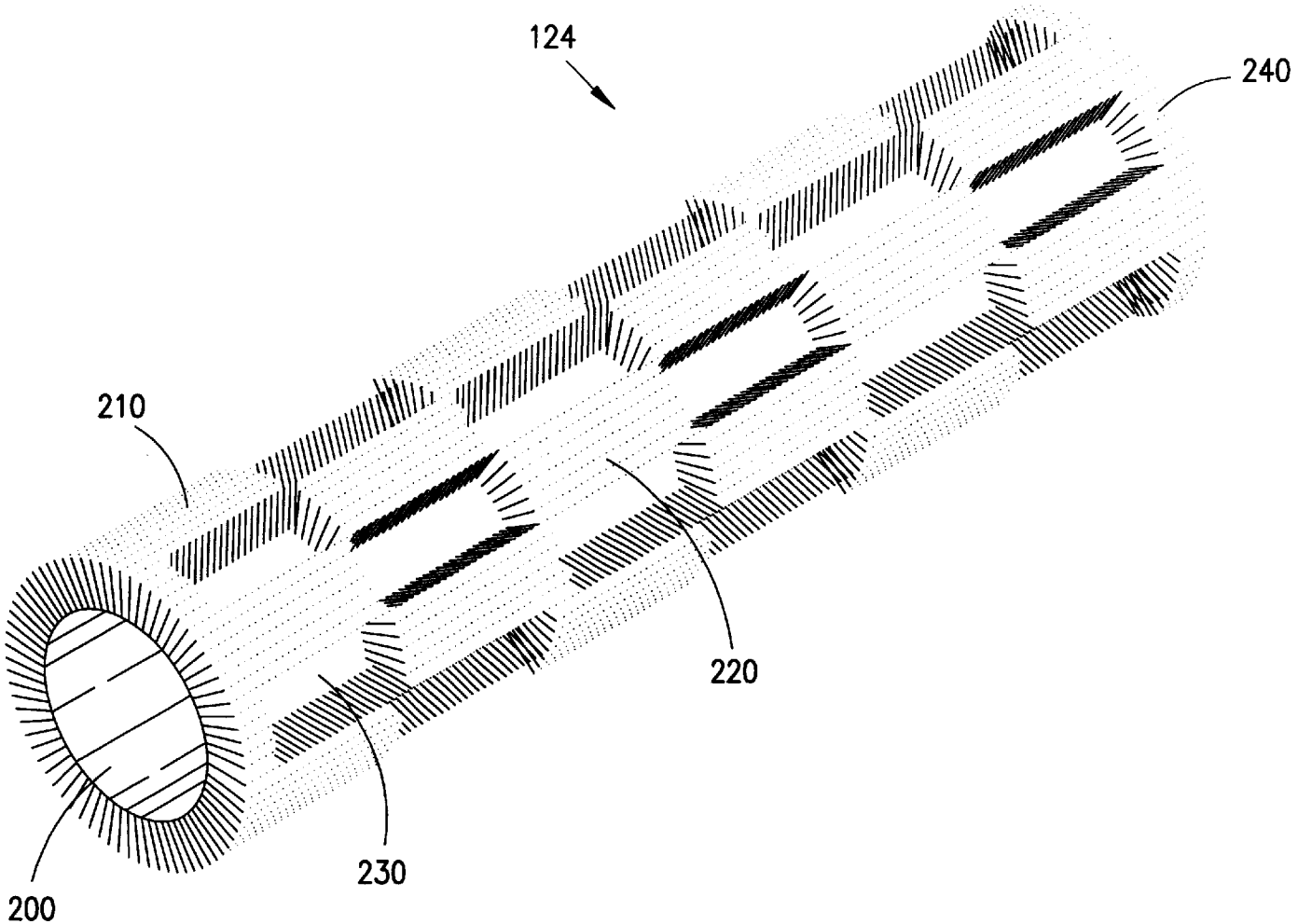
FIG. 2 is a view of a first preferred type of cylindrical brush for the sweeping machine.

FIG. 2 is a view of one preferred embodiment of a brush 124. The brush 124 shown in FIG. 2 has been removed from the sweeping machine 110. Brush 124 is a cylindrical sweeping brush and further comprises a core or brush tube 200. The core is a member to which sweeping material such as bristles can be attached. The core is also capable of being rotated. The core could be a tube, a hollow cylinder, a solid cylinders entwined metal members or the like. The brush tube 200 in FIG. 2 is made of polyethylene. The brush tube 200 has a wall thickness of approximately 0.5 inches. Attached to the tube are a plurality of tufts 210. Each tuft is comprised of a plurality of bristles. The tufts of bristles comprise the sweeping material which is attached to the brush tube 200 by use of staples that hold the tuft. The tufts are attached so as to form a varied topography across the outer diameter of the tufts of the brush. In essence, tufts 210 are attached to the brush tube 200 to form a tufted region or tufted volume of sweeping material 220. There are also regions or volumes that are totally devoid of tufts such as region or volume 230 in FIG. 2.

Figure 8:
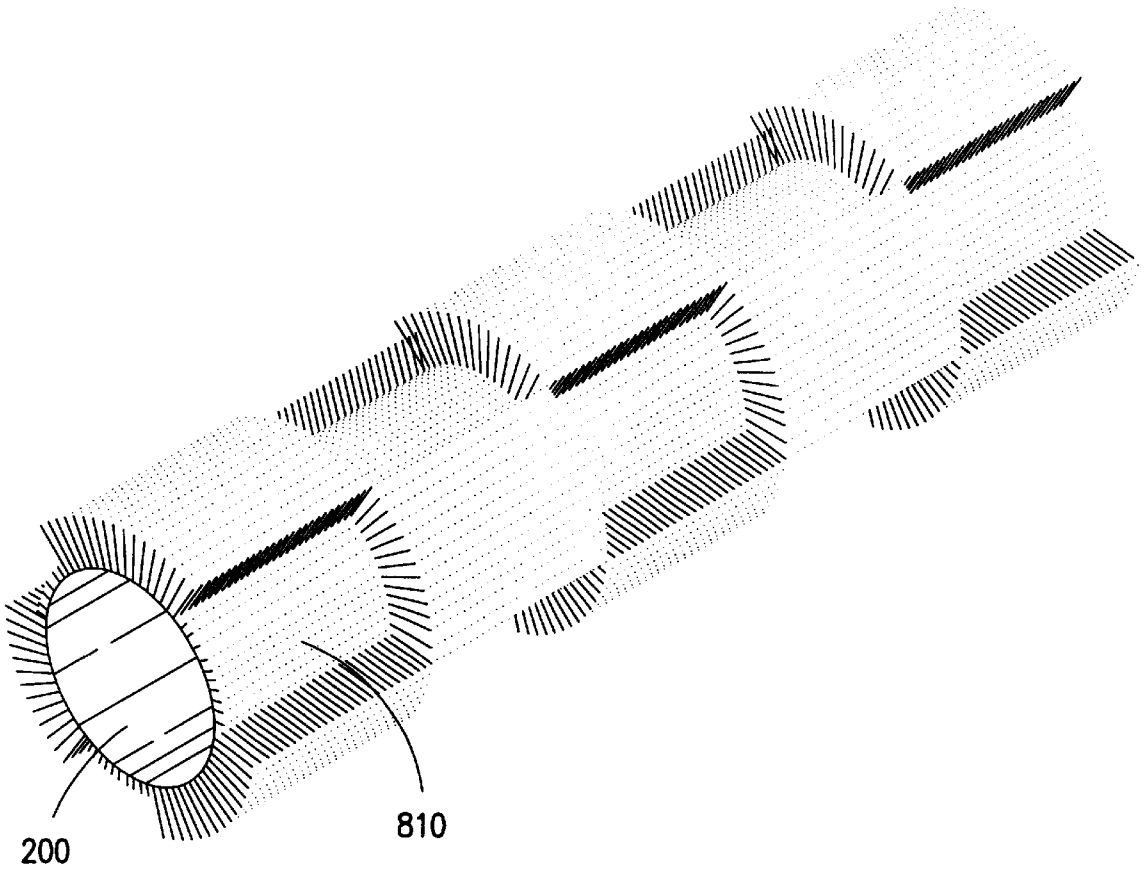
FIG. 8 is a view of a seventh preferred type of cylindrical brush for the sweeping machine.

A region devoid of sweeping material 230 could also be formed by placing short tufts on the brush tube 200. The short tufts would be so short that they would not contact surface 114 during normal operation of brush 124 until the brush has been substantially worn. A brush 800 is shown in FIG. 8 which has shortened bristles or sweeping material 810 attached to the brush tube 200. The volume above the shorter bristles 810 is the volume or area devoid of bristles or sweeping material. Now turning back to FIG. 2, the tufted regions or volumes of sweeping material 220 surround the untufted regions or volumes devoid of sweeping material 230. The untufted regions 230 are also referred to as volumes devoid of sweeping material. The tufted regions 220 bound the regions devoid of sweeping material 230. This forms a volume or pocket or window which can capture debris. The pocket or window is bounded by tufts 210 or sweeping material. The brush 124 may have full-length bristles at the end of the cylindrical brush tube 200. The bristles or sweeping material on the end 240 bound the volumes devoid of sweeping material 230 that are located at the ends of the brush. The size of the pocket or window is selected so that it can capture debris having a selected volume. For example, the brush 124 has pockets or windows which are volumes devoid of sweeping material 230 large enough to surround or fit plastic beverage bottles. Advantageously, the tufts bounding the volumes devoid of sweeping material 230 serves to capture or surround the debris while it is being swept. The windows or pockets or volumes devoid of sweeping material are also designed so as to provide for smooth operation of the sweeping machine. The windows are symmetrical and are generally not so large that a moment is placed on the brush by the sweeping machine 110. The debris, such as a plastic beverage bottle, generally will not migrate from side to side along the length of the brush tube and brash. The debris is encapsulated within the pocket or window or volume devoid of sweeping material 230 until the, debris is flung into the hopper 168 of the sweeping machine 110.

Another advantage of having the brush 124 with a volume devoid of sweeping material 230 bounded by an area populated with tufts 220 is that a favorable air flow is formed for the removal of light litter from the sweeping surface 114. Air flow is critical to the pickup of light litter. When a cylindrical brush carries full-length bristles over the entire brush, a turbulent air flow is created in front of the brush as the sweeping machine 110 moves over the surface to be swept 114. The turbulent air flow tends to push or place the light litter in front of such a brush. When the sweeping machine is equipped with the brush 124 that has pockets or volumes without sweeping material 230 bounded by volumes with full-length bristles 220, a favorable air flow for light litter pickup is created. The volumes devoid of bristles produce a fan effect directing air flow in a direction more favorable for sweeping than the prior art and provide regions large enough to entrap debris. The light litter is contained within the pocket or window 230 until it is discharged into the hopper 168. The volume of the brush which has no sweeping material can also be termed a void.

It should be noted here that brush 124 shown in FIG. 2 is populated by bristles or sweeping material with full-length bristles and that the areas devoid of sweeping material 230 have no bristles. It should be noted that an area devoid of sweeping material 230 can be formed by using short-length bristles attached to the brush tube 200. The short-length bristles would be short enough so that they would not contact the sweeping surface 114 while the sweeping machine 10 operated. The area devoid of sweeping material 230 would be the volume above the short bristles and bounded by the longer, full-length bristles. The area devoid of sweeping material 230 would be designed so that the volume would capture the desired debris for the particular application of the brush and the sweeping machine 110.

The brush can be tailored by varying several parameters of the brush. For example, the brush material type and the number of bristles (tufts) per unit area of the brush tube is one set of parameters that can be varied. The mix of bristles within a tuft can also be varied. The mix of tuft types in a tufted region is another variable parameter. In the tufted regions on the brush, each of the aforementioned parameters can be varied individually or in combination to tailor the brush. Brush fill material, also known as bristles, can be made of polypropylene, nylon, polyester, or other synthetics. The brush fill material can also be made of brush wire, or fill materials of a plant or animal origin. The cross sectional size and shape and the length of the bristles can also be varied to tailor the brush.

Figure 3:
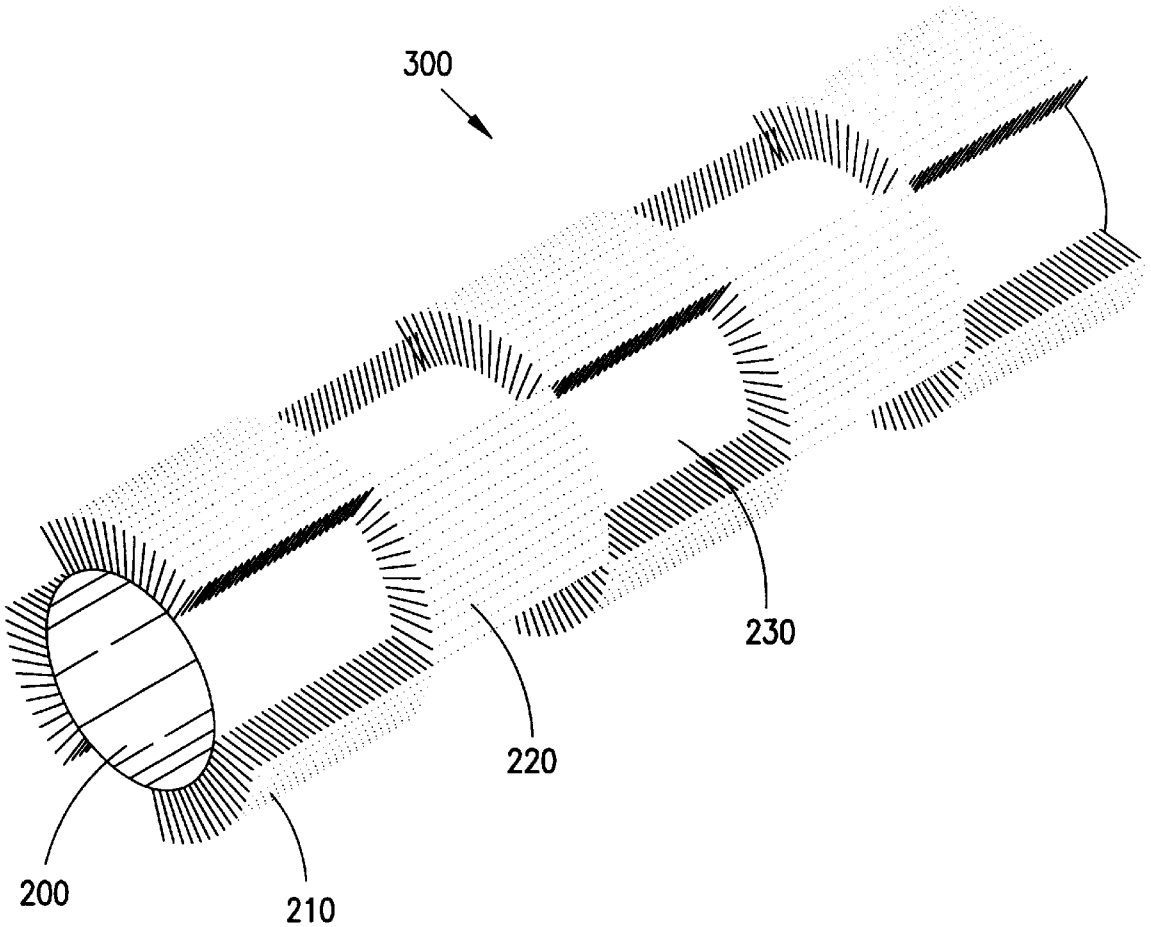
FIG. 3 is a view of a second preferred type of cylindrical brush for the sweeping machine.

Now turning to FIG. 3, we see another preferred embodiment of a brush used on the sweeping machine 110. FIG. 3 shows a brush 300. Brush 300 has a brush tube 200 made of polyethylene with a wall thickness of approximately 0.5 inches. The bristles used in the brush shown in FIG. 3 are of a different material than the bristles shown in FIG. 2. The bristles or sweeping material 210 which are attached to the brush 300 can be made of any of the various types of brush fill materials, which include fibers of plant or animal origin, synthetic filaments, metallic materials, or composite filaments. The bristles 210 are attached to the brush tube 200 and form volumes of sweeping material 220 which bound volumes devoid of sweeping material 230. In this particular application, the untufted regions or volumes sweeping material 230 are smaller compared to the regions carrying full-length bristles 220. It should be noted that the untufted regions or volumes without sweeping material 230 can be made of any size or shape. The main design consideration for the size of a pocket or window or volume devoid of sweeping material 230 is that the volume of the pocket is larger than the volume of the debris. It is contemplated that a brush could also have windows or pockets of different sizes on the same brush. It should also be noted that the volumes devoid of sweeping material 230 on the ends of the brush tube 200 are not necessarily bounded on the ends of the tube by an additional row of bristles.

Figure 4:
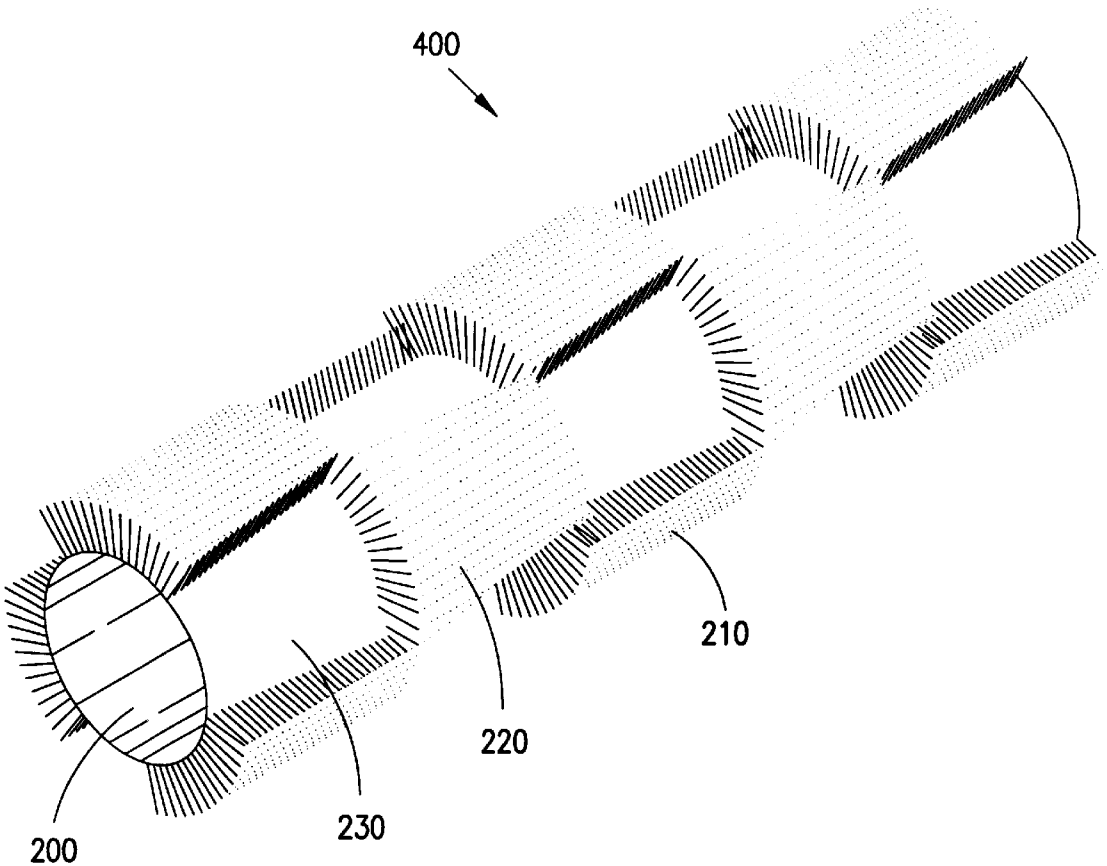
FIG. 4 is a view of a third preferred type of cylindrical brush for the sweeping machine.

FIG. 4 shows another preferred embodiment of a brush 400. Brush 400 has a brush tube 200 made of polyethylene which carries bristles 210. The bristles 210 are attached to the brush tube 200 so as to form areas with full-length bristles and volume which are devoid of sweeping material 230. The areas with full-length bristles are volumes with sweeping material 220 and the areas devoid of bristles are volumes devoid of sweeping material 230. In this particular embodiment, the edges of the volumes devoid of bristles form a spiral. In other words, the bounded areas or the edges of the bounded areas can be thought of as forming a helix which spirals along the length of the brush. This arrangement enhances the performance of the brush 400. When using this brush 400, trailing is minimized since the tufted areas 220 sweep over areas where a pocket or volume devoid of sweeping material 230 passed before. In other words, the tufted areas are, in a sense, staggered because their edges are along a spiral. The consequence is that the edges from one window or untufted regions will be swept over by a region full of bristles. The edge of the windows or pocket or volume devoid of sweeping material 230 will be swept by a volume of sweeping material 220. In this particular brush 400, the windows have an alternating spiral of 30 degrees per foot.

Figure 5:
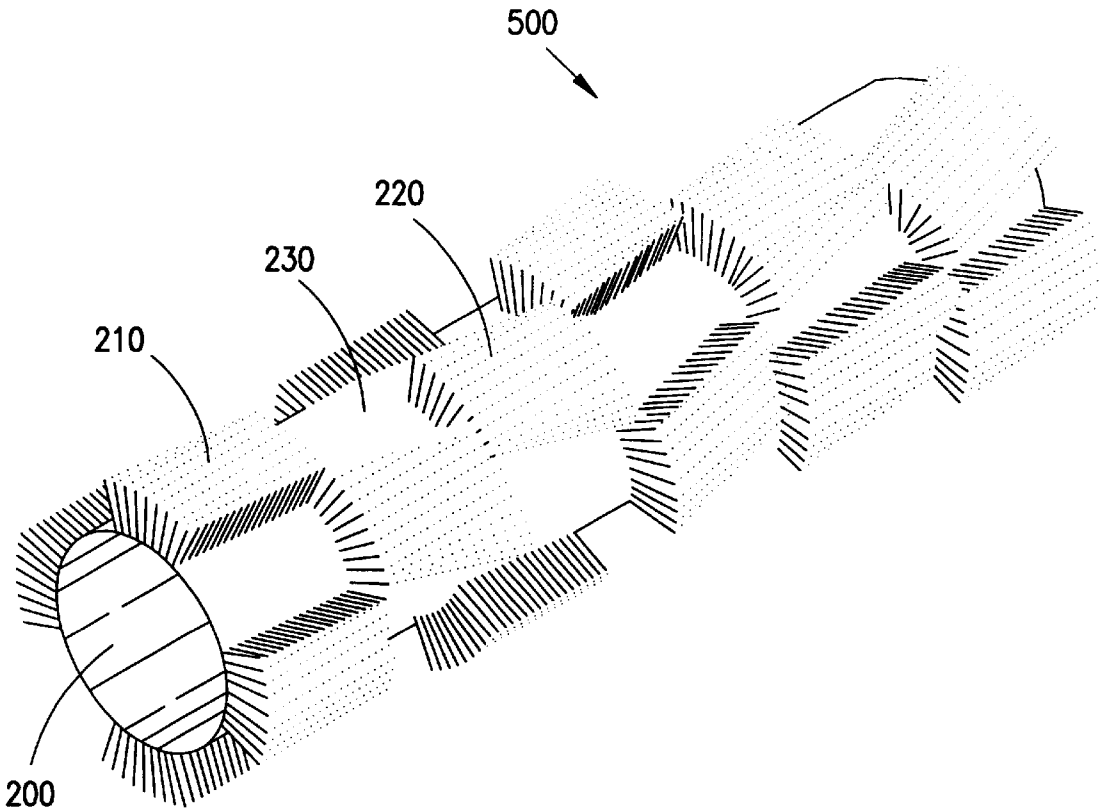
FIG. 5 is a view of a fourth preferred type of cylindrical brush for the sweeping machine.

Now turning to FIG. 5, a brush 500 is shown attached to a sweeper machine. The brush 500 is another preferred embodiment of the cylindrical brush of this invention. The brush 500 has a brush tube 200 to which bristles 210 are attached. The bristles 210 are attached so as to form volumes without sweeping material 230 bounded by volumes with sweeping material 220. The sweeping material used are full-length bristles 210. This particular brush has rather large areas devoid of bristles 230 and, therefore, is designed for removing debris with fairly large dimensions. The unique aspect of this brush is that the windows on one half of the length of the brush spiral going in toward the center of the brush which goes in a first direction. The windows or pockets on the other half of the brush spiral going the other way. In other words, there are two opposite spirals or helixes that approach the center of the brush. The two helixes meet at the center of the brush.

Figure 6:
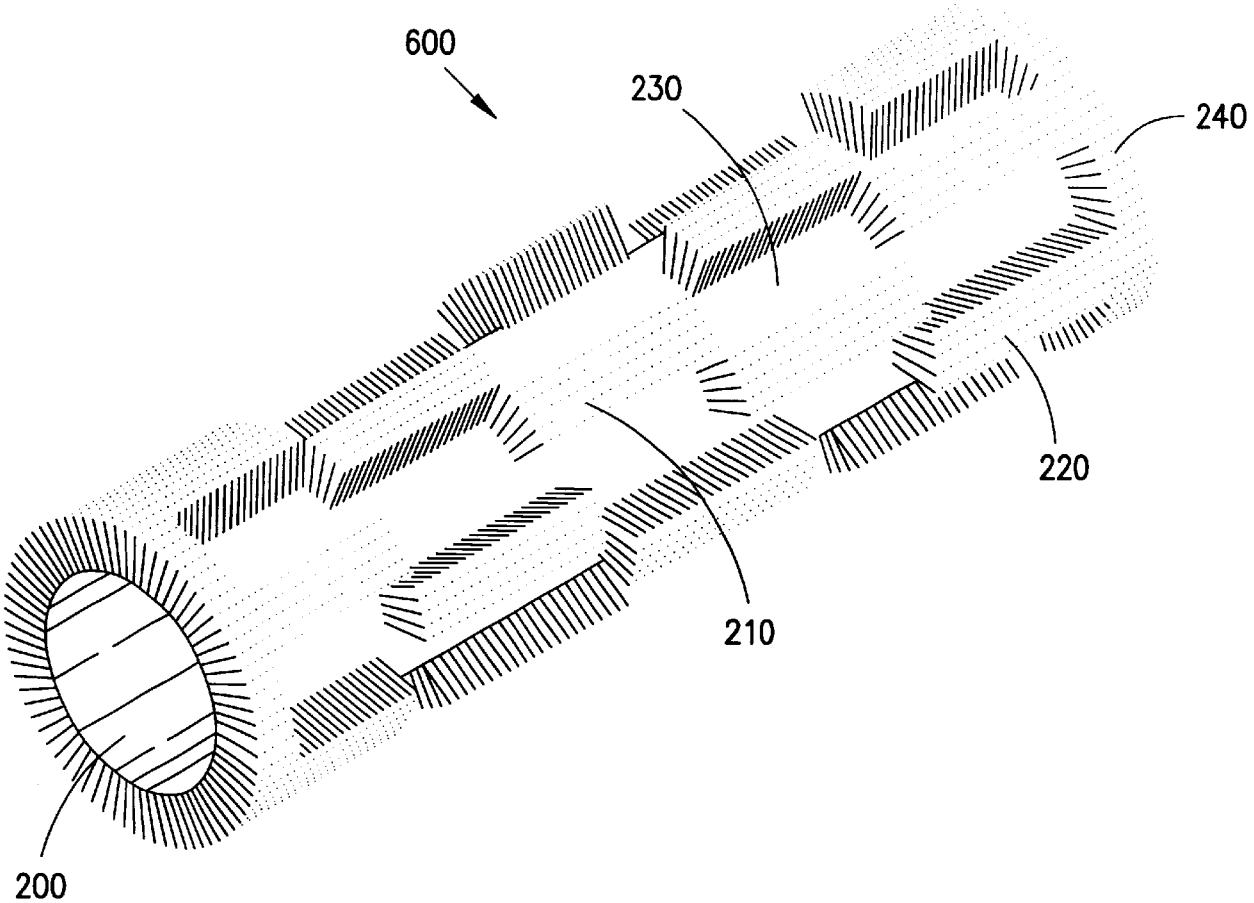
FIG. 6 is a view of a fifth preferred type of cylindrical brush for the sweeping machine.

Now turning to FIG. 6, a brush 600 is shown. The brush 600 is another preferred embodiment of the cylindrical brush of this invention. The brush 600 has a brush tube 200 to which bristles 210 are attached. The bristles 210 are attached so as to form volumes without sweeping material 230 bounded by volumes with sweeping material 220. The sweeping material used are full-length bristles 210. This particular brush has large areas devoid of bristles 230 and, therefore, is designed for removing debris with fairly large dimensions. The unique aspect of this brush is that the windows form a staggered spiral over the length of the brush 600. The staggered spiral windows are bounded by bristles at the end 240 of the brush tube 200 to form large areas devoid of sweeping material.

Figure 7:
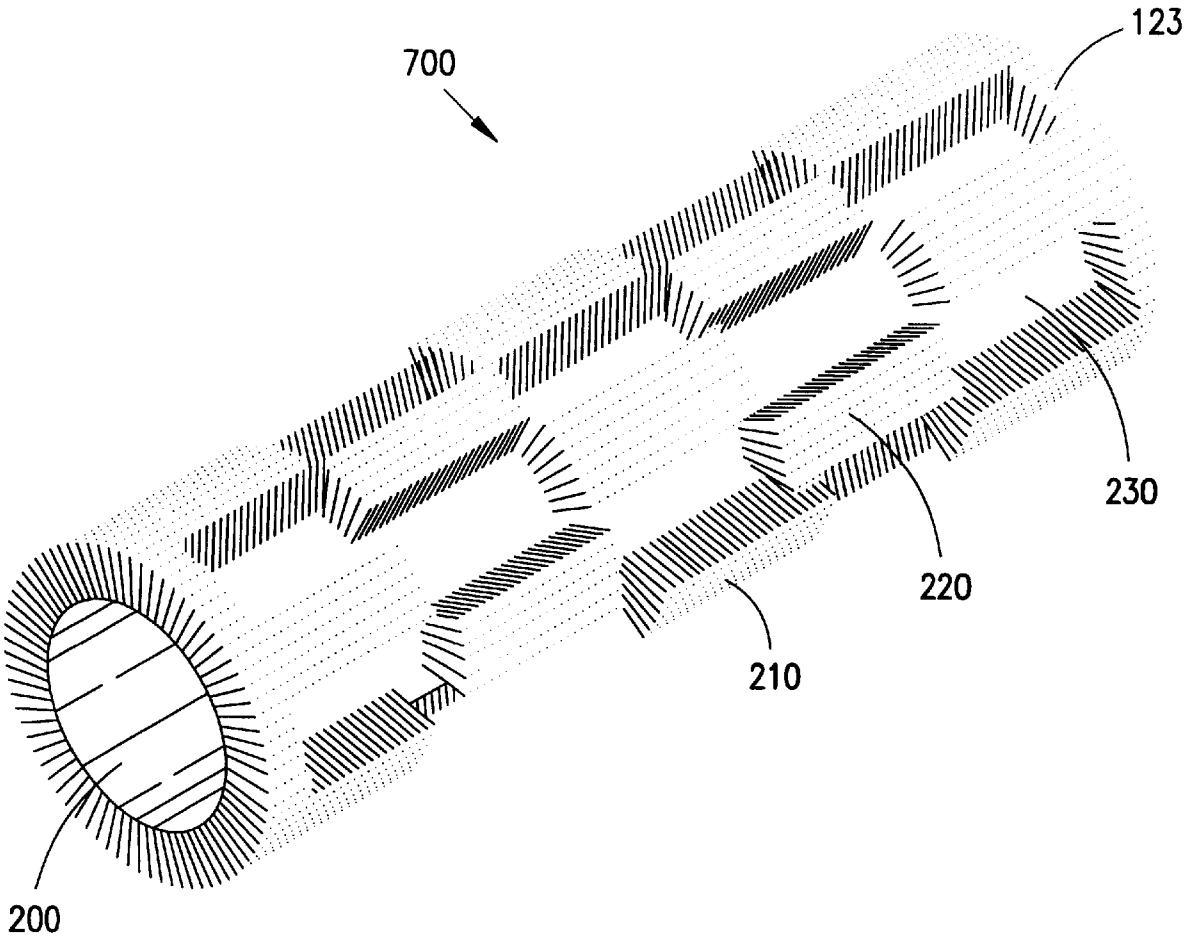
FIG. 7 is a view of a sixth preferred type of cylindrical brush for the sweeping machine.

FIG. 7 shows another brush 700 which is another preferred embodiment of the cylindrical brush of this invention.

The brush 700 has a brush tube 200 to which bristles 210 are attached. The bristles 210 are attached so as to form volumes without sweeping material 230 bounded by volumes with sweeping material 220. The sweeping material used are full-length bristles 210. This particular brush has large areas devoid of bristles 230 and, therefore, is designed for removing debris with fairly large dimensions. The unique aspect of this brush is that the windows form a staggered straight line over the length of the brush 700. The staggered straight line windows are bounded by bristles at the end 240 of the brush tube 200 to form large areas devoid of sweeping material.

Figure 9:
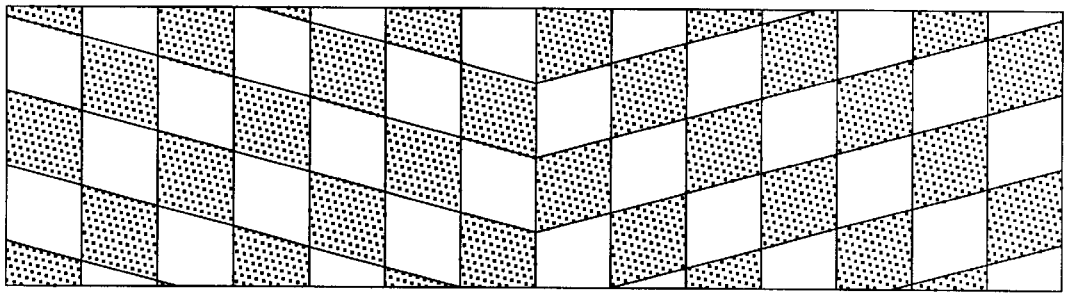
FIG. 9 is a top view of another preferred embodiment of a cylindrical brush for a sweeping machine showing different geometric shapes on the regions of the brush.

FIG. 9 is a top view of another preferred embodiment of a cylindrical brush for a sweeping machine showing different geometric shapes on the regions or areas of the cylindrical brush. The bristles attached to said cylindrical body to form a brush having a varied topography. The topography includes volumes that are devoid of sweeping material and volumes populated with bristles surrounding said volumes devoid of sweeping material. The volumes devoid of sweeping material entrap debris and limit movement of the debris along the length of the cylindrical body and around the circumference of the cylindrical body of the brush. The brush for sweeping a surface to remove debris from said surface where the volumes devoid of sweeping material are of a first geometric shape. The areas populated with bristles may be of the same geometric shape as the first geometric shape or may be of a second geometric shape. The brush for a sweeping machine may also include a plurality of third regions of sweeping material and a plurality of fourth regions devoid of sweeping material. The first and third regions of sweeping material bound said second and fourth regions devoid of sweeping material. The first and third regions of sweeping material may have different geometric shapes. The second and fourth regions devoid of sweeping material may also have different geometric shapes and form volumes which are unequal to each other.

Advantageously, a sweeping machine equipped with the cylindrical brush mentioned above picks up or sweeps all types of debris, such as sand and gravel, light litter, mil-spec hardware, containers, bulky debris and debris with mixed aspect ratios. The volume devoid of sweeping material prevent axial migration of debris toward the ends of a rotating cylindrical brush. The areas devoid of sweeping material also produce a favorable air flow to pick up paper or light debris. The areas devoid of sweeping material create a favorable air flow as the cylindrical brush spins. The light debris is pulled into the area or volume devoid of sweeping material. The tufts can also be set so that the borders between the tufted and untufted regions or volumes are at an angle with respect to the axis of the cylinder so as to minimize trailing. Trailing is leaving debris in lines behind the brush after making a sweeping pass. By making the brush symmetrical and sizing the areas devoid of tufts appropriately, the sweeping machine is both smooth and stable during the sweeping operation.

As mentioned above and as seen in the several preferred embodiments described herein, there are many different types of brush fill materials. In addition, there are many different brush tube types. Brush tubes can be made of wood, paper, plastics, high density polyethylene or other polymer types. In addition, brush tubes can be made of composites of several materials. The tufts or grouping of individual bristles can be attached to the tubes in a number of ways as well. For example, the tufts may be stapled to the brush tube or may be constructed of strip brushes. It should be noted that the invention described herein can be made using any type of bristle, any type of tube and using any way of attaching the bristles to the tube to form a brush in which the sweeping material forms a plurality of first regions of sweeping material and a plurality of second regions devoid of sweeping material.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A brush for a sweeping machine adapted to remove mixed aspect ratio debris from a surface, said brush comprising:

a core, said core having a core surface;

sweeping material attached to said core and extending radially outward from the core surface, said sweeping material forming a plurality of first regions of sweeping material and a plurality of second regions devoid of sweeping material, said first regions bounding said second regions of the core, said second regions devoid of sweeping material forming pockets for entrapping debris;

a plurality of third regions of sweeping material; and a plurality of fourth regions devoid of sweeping material, said first and third regions of sweeping material bounding said second and fourth regions devoid of sweeping material, said first and third regions of sweeping material having different geometric shapes.

2. The brush for a sweeping machine of claim 1 wherein the first and third regions form volumes which are unequal to each other.

3. The brush for a sweeping machine of claim 1 wherein the second and fourth regions devoid of sweeping material have different geometric shapes and form volumes which are unequal to each other.

4. A sweeping machine for picking up mixed aspect ratio debris from a surface, said sweeping machine comprising:

a frame;

wheels attached to said frame, said wheels for supporting said frame over said surface;

a cylindrical brush rotatably attached to said frame, said cylindrical brush further comprising:

a core, said core having a core surface;

sweeping material attached to said core and extending radially outward from the core surface, said sweeping material forming a plurality of first regions of sweeping material and a plurality of second regions devoid of sweeping material, said first regions bounding said second regions of the core, said second regions devoid of sweeping material forming pockets for entrapping debris;

a plurality of third regions of sweeping material; and a plurality of fourth regions devoid of sweeping material, said first and third regions of sweeping material bounding said second and fourth regions devoid of sweeping material, said first and third regions of sweeping material having different geometric shapes; and a mechanism for rotating said cylindrical brush.

5. The sweeping machine for picking up debris from a surface of claim 4 further comprising an arm attached to said cylindrical brush for controlling the amount of force applied between the cylindrical brush and the surface.

6. The sweeping machine for picking up debris from a surface of claim 4 wherein the regions of the cylindrical brush devoid of tufts, and the regions of the cylindrical brush having tufts which bound the regions devoid of tufts, are positioned on said tube so that the brush is symmetrical about the midpoint of the tube.

7. The sweeping machine for picking up debris from a surface of claim 4 wherein the regions of the cylindrical brush devoid of tufts, and the regions of the cylindrical brush having tufts which bound the regions devoid of tufts, are positioned on said tube so that the brush in contact with the surface being swept substantially zero moment on said frame of the sweeping machine.

8. The sweeping machine for picking up debris from a surface of claim 4 wherein the regions of the cylindrical brush devoid of tufts produce an airflow conducive for entrapping light litter within the regions of the cylindrical brush devoid of tufts.

9. The sweeping machine for picking up debris from a surface of claim 4 wherein the regions of the cylindrical brush devoid of tufts have a selected volume for removal of selected debris having a volume associated therewith from the surface.

* * * * *